United States Patent [19]

Worley et al.

[11] 4,269,166

[45] May 26, 1981

[54] STACK DAMPER VALVE

[75] Inventors: Arthur C. Worley, Mt. Tabor; Richard J. Basile, Rockaway, both of N.J.

[73] Assignee: Exxon Research & Engineering Company, Florham Park, N.J.

[21] Appl. No.: 972,478

[22] Filed: Dec. 21, 1978

[51] Int. Cl.[3] ..... F23L 3/00

[52] U.S. Cl. ..... 126/285 R; 126/285 B; 251/212

[58] Field of Search ..... 126/293, 286, 285 A, 126/285 R, 285 B, 285.5, 289, 290; 236/1 G, 93 R, 101 B; 251/212

[56] References Cited

U.S. PATENT DOCUMENTS

| | | | |
|---|---|---|---|
| 1,099,689 | 6/1914 | Broadhurst | 122/20 |
| 1,125,503 | 1/1915 | Fleck et al. | 251/212 |
| 1,773,585 | 8/1930 | Klockau | 126/285 B |
| 2,020,686 | 11/1935 | Kaiser | 122/20 |
| 3,070,345 | 12/1962 | Knecht | 251/212 |
| 3,076,469 | 2/1963 | Averill | 251/212 |
| 3,084,715 | 4/1963 | Schrarres | 126/285 R |
| 3,181,527 | 5/1965 | Forsman | 126/285 R |
| 3,241,568 | 3/1966 | Mayo, Jr. | 137/601 |
| 3,242,943 | 3/1966 | Waterfill | 137/512.1 |
| 3,507,256 | 4/1970 | Sander | 122/20 |
| 3,533,438 | 10/1970 | Smith | 137/512.1 |
| 3,888,166 | 6/1975 | Stottmann | 98/85 |

FOREIGN PATENT DOCUMENTS

| | | | |
|---|---|---|---|
| 2144890 | 3/1973 | Fed. Rep. of Germany | 126/285 R |
| 188372 | 3/1964 | Sweden | 126/285 B |
| 881436 | 11/1961 | United Kingdom | 251/305 |

*Primary Examiner*—James C. Yeung

*Attorney, Agent, or Firm*—F. D. Paris; R. S. Salzman

[57] ABSTRACT

A stack damper valve comprising a pair of semicircular steel discs typically joined by a removable piano-type hinge. Each of the discs pivot upwardly in the direction of flow from a closed to an open position and vice versa. In the closed position the discs seat in a metal-to-metal relationship against a circular truncated steel seat which is secured such as by welding to the inner surface of the steel stack in which the valve is mounted.

1 Claim, 5 Drawing Figures

STACK DAMPER VALVE

BACKGROUND OF THE INVENTION

The present invention relates to damper valves and more particularly to an improved stack damper valve primarily for use in stack systems which operate at relatively high temperatures and function as tight shutoff block valves in either lined or unlined duct systems.

Previously stack systems employed valves of the butterfly type which basically comprise a single valve disc with a concentrically located shaft. This valve design does not provide tight shutoff due to the clearances required between the valve disc and stack lining or wall. These prior art valves have proved unsatisfactory, since they do not provide the desired tight shutoff characteristics and also cannot be used in both unlined and lined systems. Typical valves comprise those employed as ceiling diffusers for air conditioning or heater duct systems wherein the valves are primarily used to balance flow to the air conditioning and the heating duct systems. Other prior art valves can be found in U.S. Pat. Nos. 3,507,256, 2,020,686, and 3,181,527; however, they do not disclose the desireable seating and hinge pivot support of the present vlve and are not suitable for use both in a low temperature unlined stack and high temperature lined stock. Other less relevant patents located include U.S. Pat. Nos. 1,099,689, 3,084,715, 3,241,586, and 3,533,438.

SUMMARY OF THE INVENTION

The present invention provides an improved tight shutoff stack damper valve which is particularly suitable both for high temperature and low temperature stock operating conditions. According to the invention, the stack damper valve comprises two half or semi-circular steel discs which are pivotally joined by means of a piano hinge arrangement including a removble pivot spindle defining the pivot axis. The rotation of the discs in the direction of flow will permit flow control to be achieved and the discs can be disposed in either the extreme closed position wherein the discs are in contact with a circular steel seat welded to the inner surface of the steel stack, or in the open position wherein the discs are contiguously adjacent one another in line with the direction of flow (lying in the plane of the duct axis) substantially perpendicular to the seating plane of the valve. Once the pivot spindle has been removed, this enables the removal of either or both of the discs. The discs also can be disposed at any position between the extreme open and closed positions. Operators in the form of manual or automatic controls can be employed for movement of the discs and a counterweight also may be provided to insure that the discs are disposed in a fail-open or fail-shut position as the case may be.

DESCRIPTION OF THE PREFERRED EMBODIMENTS

Figure 1:
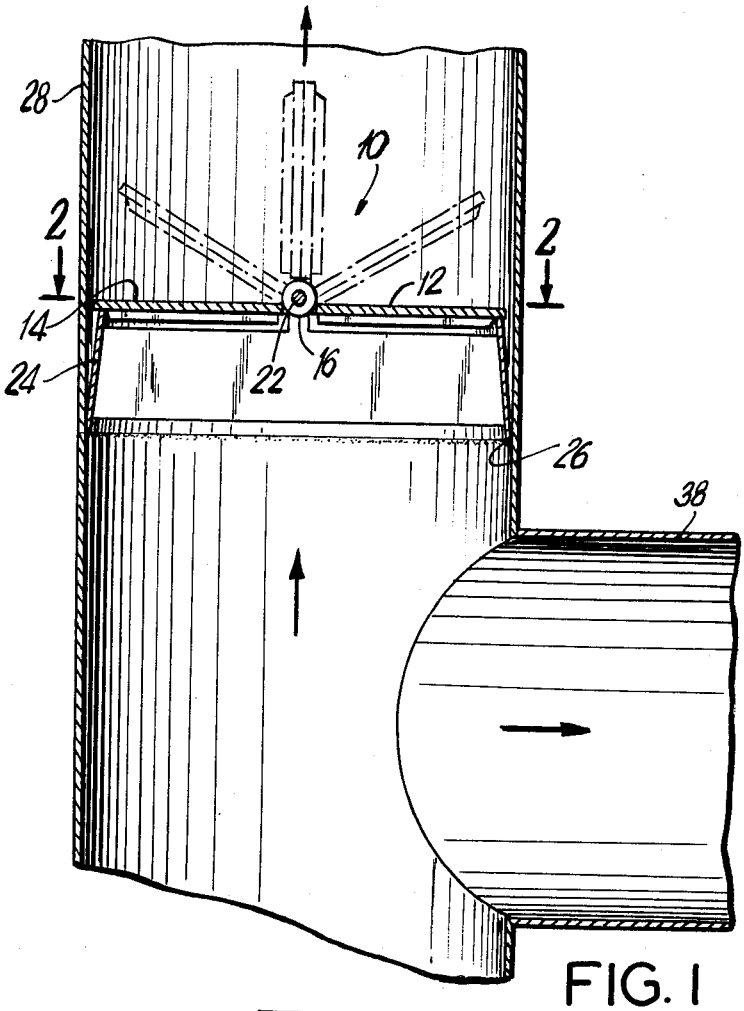
FIG. 1 shows an improved stack damper vlve mounted in an unlined stack for low temperature operation in its closed (solid lines) and open (broken lines) positions, constructed and arranged according to the present invention.
Figure 3:
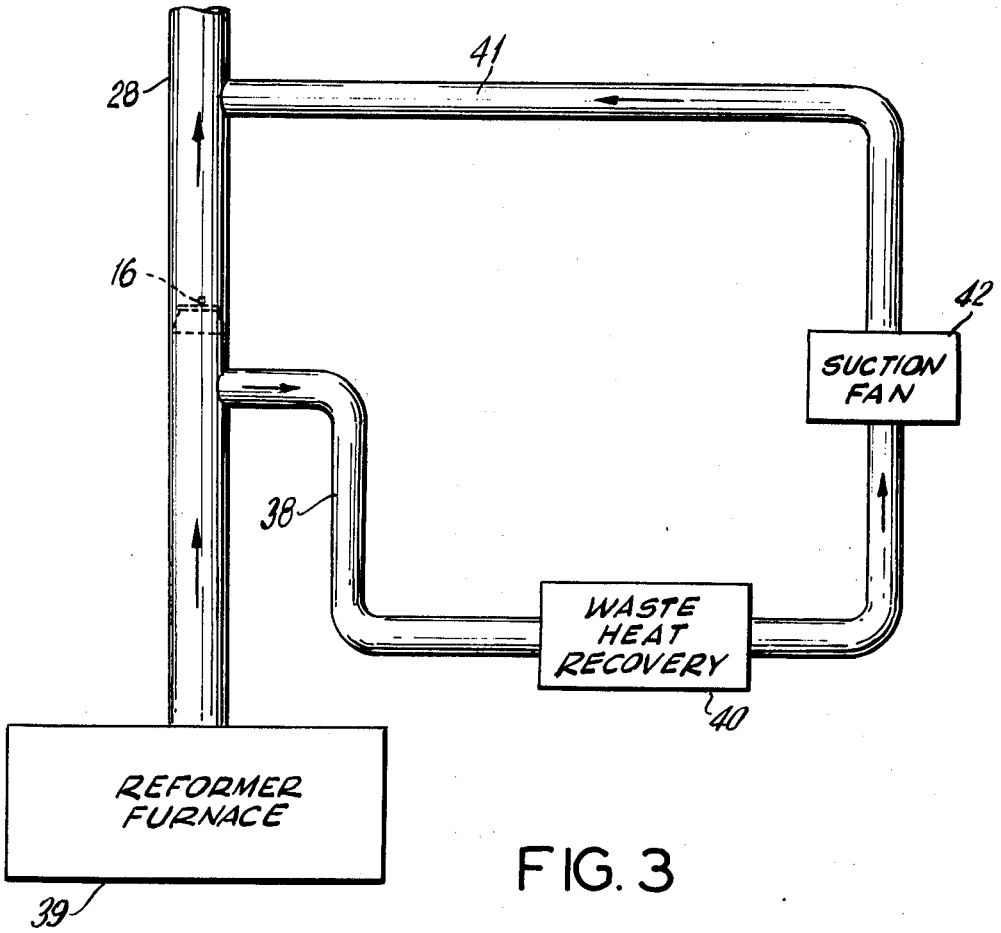
FIG. 3 illustrates a typical valve mounted in the stock for a reformer furnace.

Referring now to the drawing wherein like parts are designated by the same reference numerals throughout the several views, there is shown in FIG. 1 a stack damper valve 10 disposed in a flue gas heat recovery arrangement, for example, as shown in FIG. 3. The valve basically comprises two semi or half-circular steel discs 12, 14, which are pivotally connected along their straight inner edges by means of a piano-type hinge 16. Each of the inner flat ends or edges of the disc include a plurality of spaced pipe or cylindrical sections 18, 20, respectively, for alignment with the respective spaces on the opposing disc edges whereupon the edges abut and the sections 18 and 20 are aligned to be coaxial, with a steel pin 22 inserted through the full length of the hinged pipe sections. The pin can be removed as described hereafter, such that each of the half circular valve discs 12, 14 can be removed. The valve seats in metal-to-metal relation against a circular steel seat 24, which is welded continuously at and about its bottom edge as shown at 26 to the steel stack 2 to provide for low leakage and durability. The seat may comprise a truncated steel cone having a smaller diameter the downstream direction at its seating end for engagement withe the discs. Also, the downstream or seating edge of the metal seat will be machined in order to provide a true plane, with respect to the valve discs, for seating. The mating disc surfaces which contact the seat are also true in order to insure a continuous metal-to-metal contact which provides for minimum leakage completely about the stack.

Figure 2:
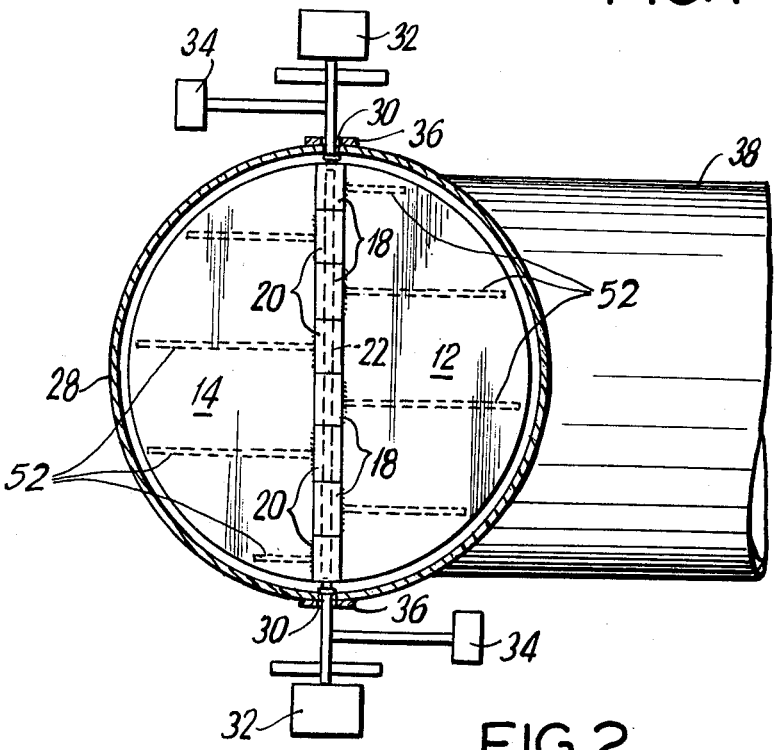
FIG. 2 illustrates a cross-sectional view taken substantially along the line 2–2 of FIG. 1, showing the valve in its closed position.

As shown in FIG. 2, the valve discs 12 and 14 each comprise a plurality of stiffening ribs 52 facing the seat.

The valve seat will support the discs because of its contact with the discs and the hinge is supported at opposite ends by the seat as well. In the case of larger diameter ducts or stacks additional plate beams (not shown) can be provided to support the increased span of the discs. These beams would be welded in the contact plane to the seat structure itself so that when discs are in their closed position, they will rest on the beams. The piano hinge basically comprises the plurality of spaced pipe sections 18, 20 which are held together and in alignment by means of the steel hinge pin 22 which can be removed through the openings 30 which are provided in the steel stack for accommodating the drive mechanisms 32 for the valve. These drives may be mechanical or hydraulic or comprise some other appropriate conventional mechanism. The valve also may include a counterweight 34 which will cause the valve discs in the case of failure of the drive mechanisms to be either in the open or shut position depending on what fail safe operation is desired. If a "fail-close" position is desired, the counterweight will be placed at 90° down from (FIG. 2) the plane of the valve discs, and for "fail-open" (see FIG. 2), they will be placed at 180° with respect to the valve discs (so that the valve opens when the counterweight drops). When the valve is used for blocking service to prevent any flow, the seating force for the valve on the metal seat is generated by the weight of the valve discs per se if there is no counterweight, as well as the differential pressure created by the draft fan on the discs and any externally applied closing torque by the drive mechanisms.

To eliminate problems of differential thermal movement between the steel stack discs and the seat structure, a relatively loose female/male socket type drive can be used at either end of the discs to allow for such movement. The female socket drive will pass through the stack wall nozzle opening through a stuffing gland 36 and terminate inside the stack where it engages the male socket ends which are attached at the end of the disc or hinge assembly.

The valve according to this invention has utility in lined or unlined systems and as shown in FIG. 1 is in an unlined system. However, it should be understood that a lining of refractory can be provided where the temperature is in the range of about 350° F. to about 1500° F., in which environment the valve construction remains as illustrated. As shown in FIG. 3, the valve is in a furnace flue gas stack which is used for recovering the heat from the reformer. This stack typically is internally lined and the flue gas temperature is approximately 1200° F. and the expected leakage passing through the valve is less than 0.3%. To operate the valve the discs are moved upwardly into the extreme dotted axial position as shown in FIG. 1 which is perpendicular to the seating plane, or to an intermediate position also shown in FIG. 1.

While the valve is shown in a circular stack or duct, it is recognized and also is applicable to rectangular or square ducts or stacks. The ducts may take any axial orientiation and as previously mentioned can be with or without an internal lining. The metal-to-metal seating employed is applicable to all temperatures up to 1500° F. The valve is exposed to the gas flow whether it is open, in throttling, or closed position, and therefore, thermal distortion of the components is not a problem. As shown, the flow is in the direction of the arrow and is exhausted to the atmosphere. In FIG. 3 the flow from the reformer furnace with the damper valve closed will pass through the inlet 38 into the conventional waste heat recovery system 40 and be drawn out by means of the suction fan 42 and thereafter, exhausted to the atmosphere via condict 44 and exhaust stack 28.

Figure 4:
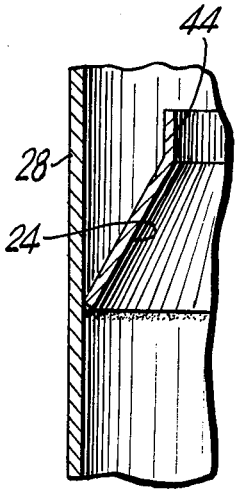
FIG. 4 illustrates an enlarged partial cross-sectional view of one type of metal seat for the present valve.
Figure 5:
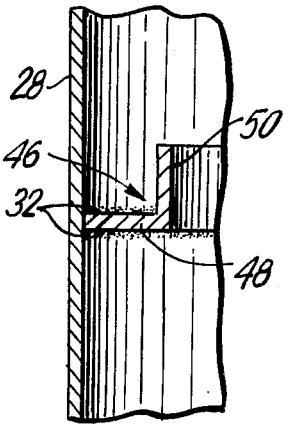
FIG. 5 illustrates an enlarged cross-sectional view of another type of metal seat for the present valve.

FIG. 4 illustrates a modified type of seating wherein the upper portion 44 of the seat is substantially parallel with the stack wall spaced inwardly therefrom. Another type of right angle seating is shown by the right angle seat 46 having a radial flange 48 and upstanding member 50. A continuous weld 52 at the stack wall end of flange 48 secures the seat in the stack.

What is claimed is:

1. A damper valve for use in stack systems comprising a pair of steel semi-circular members having contiguous straight edges and axially aligned hinged pipe sections disposed along said contiguous straight edges which are interconnected by means of a removalbe pin extending through said aligned sections and whose axis is disposed transverse of the axis of said stack, an annular steel seat comprising a truncated circular steel member welded to and extending continuously about the interior of said stack, said semi-circular members having a plurality of stiffening ribs facing said seat, said semi-circular members being mounted and arranged for metal-to-metal seating contact with said seat in a closed position of said valve and movable between said closed position and an open position wherein said semi-circular members are disposed downstream of said annular steel seat, said semi-cicrular members interconnected only along said straight edges when said semi-circular members are in either of said open and closed positions, operator means disposed externally of said stack and operably connected for disposing said semi-circular members in said open or closed positions, and counterweight means disposed externally of said stack and operably connected with said semi-cicrcular members for providing fail-safe operation of said semi-circular members.

* * * * *